US006127991A

United States Patent [19]

Uehara et al.

[11] Patent Number: 6,127,991

[45] Date of Patent: Oct. 3, 2000

[54] METHOD OF DRIVING FLAT PANEL DISPLAY APPARATUS FOR MULTI-GRADATION DISPLAY

[75] Inventors: Hisao Uehara, Ogaki; Mitsugu Kobayashi, Nagoya; Makoto Kitagawa, Anpachi-gun; Yusuke Tsutsui, Motosu-gun, all of Japan

[73] Assignee: Sanyo Electric Co., Ltd., Osaka, Japan

[21] Appl. No.: 08/969,142

[22] Filed: Nov. 12, 1997

[30] Foreign Application Priority Data

| | | | |
|---|---|---|---|
| Nov. 12, 1996 | [JP] | Japan | 8-300600 |
| Nov. 14, 1996 | [JP] | Japan | 8-303177 |
| Nov. 29, 1996 | [JP] | Japan | 8-320361 |

[51] Int. Cl.[7] ..... G09G 3/28

[52] U.S. Cl. ..... 345/60; 345/89

[58] Field of Search ..... 345/60, 63, 77, 345/89, 147

[56] References Cited

U.S. PATENT DOCUMENTS

| | | | |
|---|---|---|---|
| 4,980,678 | 12/1990 | Zenda | 340/716 |
| 5,202,773 | 4/1993 | Kato | 358/461 |
| 5,394,194 | 2/1995 | Izawa et al. | 384/672 |
| 5,757,343 | 5/1998 | Nagakubo | 345/63 |

*Primary Examiner*—Amare Mengistu
*Assistant Examiner*—Vanel Frenel
*Attorney, Agent, or Firm*—Loeb & Loeb, LLP

[57] ABSTRACT

There is proposed is a method of controlling a flat panel display apparatus for multi-gradation display in which a data determination portion and a subfield control portion are provided. Based on a most significant bit or an upper bit of original image data, it is determined in which one of two or more divided gradation groups the original image data is included, to select a combination of subfields in accordance with a gradation-brightness characteristic of the belonging gradation group. Using a complementary relationship with human visibility, a difference in brightness between the gradations in a low-order brightness region is reduced, and a difference in brightness between the gradations in a high-order brightness region is enlarged. Therefore, a density of brightness is uniformly recognized visually over all the brightness regions, and a good quality of display can be obtained.

10 Claims, 13 Drawing Sheets

METHOD OF DRIVING FLAT PANEL DISPLAY APPARATUS FOR MULTI-GRADATION DISPLAY

BACKGROUND OF THE INVENTION

1. Field of the Invention

The present invention relates to a method of driving a plasma display panel (hereinafter abbreviated to PDP) or another flat panel display for performing a gradation display in accordance with a period of lighting time.

2. Description of the Prior Art

The PDP obtains a desired display image by controlling light emitting and non-light emitting of each pixel by the use of plasma discharge. The PDP is advantageously thin, and has been prosperously developed as a flat panel display together with a liquid crystal display (abbreviated to LCD) and the like.

In the PDP, a row electrode and a column electrode are formed on a pair of opposed substrates in such a manner that the electrodes intersect each other with a discharge space therebetween on the substrates, and a gap in the substrates is filled with gas for electric discharge. By applying voltage to a discharge cell at an intersecting portion of the column electrode and the row electrode designated in a matrix manner, electric discharge and light emitting are performed. Such spotted electric discharge and light emitting are macroscopically recognized to form a character, a graphic form or another image. In the PDP using such a principle, a light emitting quantity by means of discharge cannot be linearly controlled by the applied voltage. Therefore, multiple gradations are obtained by controlling a lighting time in each pixel in accordance with brightness.

FIG. 1 shows a prior-art constitution of the PDP. Original image data, for example, eight bits data, R, G and B are transmitted to a multi-gradation processor 10, in which an error diffusion process is performed as detailed by applicants of the present application in the U.S. Pat. No. 5,596,349. The data are converted to data of predetermined bits, for example, four bits. The converted original image data are temporarily stored in a frame memory 11, then transmitted to a data controller 12. Predetermined pixel data is then prepared and supplied to a data driver 18 of a PDP display portion 15. On the other hand, a horizontal synchronous pulse SYNC separated from a composite video signal is transmitted to a subfield timing control portion 13, in which signal pulses for controlling column and row, subfield, field, frame and other various timings are prepared and supplied to the multi-gradation processor 10, the frame memory 11, the data controller 12 and a driver controller 14. The driver controller 14 is controlled by the subfield timing control portion 13, to control driving timings of a Y electrode driver 16, an X electrode driver 17 and a data driver 18 of the PDP display portion 15.

In the PDP display portion 15, plural Y electrodes 19 and plural X electrodes 20 are disposed parallel with one another, and intersected by plural data electrodes 21. The Y electrodes 19 and the X electrodes 20 are formed on one substrate, while the data electrodes 21 are formed on the other substrate. The Y and X electrodes 19 and 20 are covered with dielectric layers. On the substrate on which the data electrodes 21 are formed, fluorescent materials R, G and B are provided. In discharge cells constituted of the Y electrodes 19, the X electrodes 20 and the data electrodes 21, respectively, a discharge space is partitioned by barrier ribs constituted of insulation layers formed on the substrates.

The Y electrode driver 16 supplies to the Y electrodes 19 row-directional scanning pulses and common pulses, and the X electrode driver 17 supplies to the X electrodes 20 common pulses. All the X electrodes 20 formed on the substrate are driven in common. Also, the data driver 18 supplies address pulses to the data electrodes 21, thereby addressing the data electrodes 21 in a column direction. The constitution provided with these three types of electrodes is called a three electrode type.

In the three electrode type of PDP, one field is constituted of plural subfields, and each subfield is mainly constituted of an address period and a maintenance discharge period. During each address period, one row constituted of each pair of the Y electrode 19 and the X electrode 20, i.e. one scanning line, is first selected. Specifically, a scanning pulse is applied to the Y electrodes 19 and a sufficiently large voltage is applied between the Y electrode 19 and the X electrode 20. In this condition, a signal voltage is applied from the data driver 18 to a specified data electrode 21, and writing discharge is performed in the discharge cell corresponding to one spot designated in a matrix manner. Thereby, a wall charge is formed on the dielectric layer over the Y electrode 19 and the X electrode 20. Subsequently, during the maintenance discharge period, maintenance discharge pulses are simultaneously applied alternately to the Y electrodes 19 and the X electrodes 20. The wall charge selectively prepared in the address period moves between the Y electrode 19 and the X electrode 20 so as to change its polarity. While maintaining the charge, electric discharge and light emitting are performed. The discharge is repeated bidirectionally in positive and negative directions, thereby lighting to display a sufficient brightness.

In a batch erasing and writing system, at the time of batch writing prior to the address period, the data driver 18 applies signal voltages simultaneously to all the cells and produces wall charges on all the cells. Subsequently, during the address period, the data driver 18 selectively applies erasing pulses. The erasing pulse is smaller in wavelength and amplitude than the maintenance discharge pulse. By applying to the cell to which the erasing pulse has been supplied a voltage with a polarity reverse to that of the wall charge produced at the time of writing, an erasing discharge is performed to erase the wall charge. During the maintenance discharge period, as aforementioned, the maintenance discharge pulses are applied alternately to the Y electrodes 19 and the X electrodes 20, to repeat the maintenance discharge predetermined times.

When the gradation display is performed in the PDP, the brightness of each pixel constituting the discharge cell is controlled by changing a length of the maintenance discharge period which is controlled by a frequency of the maintenance discharge in each discharge cell. Specifically, plural subfields respectively having the maintenance discharge period which is associated with a desired brightness ratio are produced in the subfield timing control portion 13. By allocating each bit of the original image data to these subfields, a combination of subfields to be lit is selected. Specifically, the pixel is only lit in the selected subfield. The total length of the maintenance discharge periods of each pixel is controlled and associated with the gradation of the original image data. The sum of the lighting periods is regarded as a desired display brightness.

A composite video signal for use in output of a TV broadcasting or computer image has heretofore been gamma-compensated in accordance with a display characteristic of a cathode-ray tube (CRT). Therefore, in the case of display on a display unit other than the CRT using the above described composite video signal, brightness is compensated to coincide with a voltage-brightness characteristic inherent in the display unit. Also in the constitution shown in FIG. 1, each of the original image data R, G and B supplied to the multi-gradation processor 10 has a curve of voltage-brightness relationship straightened by applying the gamma-compensation for the PDP further to a signal gamma-compensated at the time of transmitting an image or at the time of output from the computer. In the example, display in sixteen gradations can be obtained from the original image data of four bits. However, the curve of the relationship between the gradation and the display brightness is straight. That is to say, a difference in brightness between the gradations is made equal at all the levels. However, in the case of actual visual observation, human visibility is high in a low brightness region, and the difference in brightness can be clearly recognized. Conversely, in a high brightness region, the visibility is low, and the difference in brightness cannot be easily recognized clearly. Therefore, in the case of visual recognition, the brightness is varied in density across all the brightness regions, and display quality is deteriorated.

SUMMARY OF THE INVENTION

An object of the present invention is to provide a method of driving a flat panel display apparatus for multi-gradation display which has low variety of difference of observable brightness across all brightness regions and has a high display quality.

To attain this and other objects, the invention provides a method of driving a flat panel display apparatus for displaying a brightness varying with pixels by means of multi-gradation display in which gradation display is performed by making a difference in brightness between gradations on a low brightness side of multiple gradations smaller than a difference in brightness between gradations on a high brightness side of multiple gradations.

According to the invention, the difference in brightness between the gradations compressed in the low brightness region where high human visibility is high is expanded and visually recognized. Conversely, the difference in brightness between the gradations expanded in the high brightness region where visibility is low is compressed and visually recognized. As a result, compression in brightness is eliminated over all the brightness regions.

Also, in the method of driving the flat panel display apparatus of the invention, in one field period constituted of plural subfield periods, to display a desired brightness, each of the plural subfield periods is set to a pixel lighting period in accordance with a relative brightness ratio. Multiple gradations are divided into plural gradation groups between a low brightness and a high brightness. It is determined to which of the plural gradation groups a brightness level indicated by the original image data belongs. Plural subfield period groups are prepared by combining predetermined subfield periods of the plural subfield periods, so that the difference in brightness between the gradations in the gradation group on the low brightness side among the plural gradation groups is smaller than the difference in brightness between the gradations in the gradation group on the high brightness side. Either one of the plural subfield period groups is selected by determining to which of the plural gradation groups the original image data belongs. The original image data is associated with the respective subfield periods in the selected subfield period group, and the multi-gradation display is performed by controlling lighting and non-lighting of each pixel in the subfield period.

Further in the invention, it is determined from a predetermined upper bit of the original image data with a digital form to which one of the plural gradation groups the brightness level of the original image data belongs.

In this manner by determining the gradation group to which the brightness level belongs based on the upper bit of the original image data, a quick determination can be made with a simple constitution.

Also, the invention provides a method of driving a flat panel display apparatus in which in one field period constituted of plural subfield periods, to display a desired brightness, each of the plural subfield periods is set to a pixel lighting period in accordance with a relative brightness ratio. By controlling lighting and non-lighting of each pixel in the plural subfield periods, the total lighting time of each pixel in one field period is controlled to perform a multi-gradation display. Multiple gradations are divided into plural gradation groups between a low brightness and a high brightness, and a difference in brightness between gradations in the gradation group on a low brightness side is made smaller than a difference in brightness between gradations in the gradation group on a high brightness side.

Further, in the invention, one field period is constituted of n+1 subfield periods. Gradations of $2^n$ levels are divided into a $2^{n-1}$-gradation group on a low brightness side and a $2^{n-1}$-gradation group on a high brightness side. By determining to which one of the $2^{n-1}$-gradation group on the low brightness side and the $2^{n-1}$-gradation group on the high brightness side the original image data belongs, predetermined n+1 or less subfield periods are selected from the n+1 subfield periods, so that the difference in brightness between the gradations in the gradation group on the low brightness side among the plural gradation groups becomes smaller than the difference in brightness between the gradations in the gradation group on the high brightness side. The original image data is associated with the selected subfield periods, and by controlling lighting and non-lighting of each pixel in the selected subfield periods, a $2^n$-level gradation display is performed.

For example, in a condition of n=4, sixteen levels of gradations in total are divided into gradation groups on the low brightness side and the high brightness side. From five subfield periods, a specified five or less, concretely four subfield periods are selected.

Also in the invention, one field period is constituted of n+2 subfield periods. Gradations of $2^n$ levels are divided into a $2^{n-2}$-gradation group on a low brightness side, a $2^{n-2}$-gradation group on an intermediate brightness side and a $2^{n-1}$-gradation group on a high brightness side. By determining to which one of the three gradation groups the original image data belongs, a specified n+2 or less subfield periods are selected from the n+2 subfield periods, so that the difference in brightness between gradations in the gradation group on the lower brightness side among the three gradation groups becomes smaller than the difference in brightness between gradations in the gradation group on the higher brightness side. The original image data is associated with the selected subfield periods, and by controlling lighting and non-lighting of each pixel in the selected subfield periods, a $2^n$-level gradation display is performed.

For example, in the aforementioned constitution, one field period is constituted of six subfield periods. Sixteen levels of gradation are divided into a four-gradation group on a low brightness side, a four-gradation group on an intermediate brightness side and an eight-gradation group on a high brightness side. By determining to which one of the three gradation groups the original image data belongs, from the six subfield periods, six or less specified subfield periods are selected, so that the difference in brightness between gradations in the gradation group on the lower brightness side among the three gradation groups becomes smaller than the difference in brightness between gradations in the gradation group on the higher brightness side. Each of four bits of the original image data is associated with the selected subfield periods, and by controlling lighting and non-lighting of each pixel in the selected subfield periods, a sixteen-level gradation display is performed.

In this manner, by dividing the gradations into three groups and selecting predetermined subfield periods from the six subfield periods in each gradation group, the difference in brightness of the gradation group on the lower brightness side can be easily reduced. Also, when the gradations are divided into more gradation groups, in the gradation group on the lower brightness side with the highest human visibility and the gradation group on the intermediate brightness side with a relatively high visibility, the difference in brightness can be set in accordance with the visibility. Also, since signals are easily processed, the driving method can be realized with a simple constitution.

Also in the invention, one field period is constituted of n+3 subfield periods. In this case, $2^n$ gradations are divided into a $2^{n-2}$-gradation group on a low brightness side, a $2^{n-2}$-gradation group on an intermediate brightness side and a $2^{n-1}$-gradation group on a high brightness side. By determining to which one of the three gradation groups the original image data belongs, n+3 or less subfield periods are selected from the n+3 subfield periods, so that the difference in brightness between gradations in the gradation group on the lower brightness side among the three gradation groups becomes smaller than the difference in brightness between gradations in the gradation group on the higher brightness side. The original image data is associated with the selected subfield periods, and by controlling lighting and non-lighting of each pixel in the selected subfield periods, a $2^n$ gradation display is performed.

For example, one field period is constituted of seven subfield periods. Sixteen levels of gradations are divided into a four-gradation group on a low brightness side, a four-gradation group on an intermediate brightness side and an eight-gradation group on a high brightness side. By determining to which one of the three gradation groups the original image data belongs, from the seven subfield periods, seven or less, concretely four specified subfield periods are selected, so that the difference in brightness between gradations in the gradation group on the lower brightness side among the three gradation groups becomes smaller than the difference in brightness between gradations in the gradation group on the higher brightness side. Each of four bits of the original image data is associated with the selected subfield periods, and by controlling lighting and non-lighting of each pixel in the selected subfield periods, a sixteen-level gradation display is performed.

In this manner, also when seven subfield periods are set, the difference in brightness of the gradation group on the low brightness side can be sufficiently reduced with a simple process. Also, the difference in brightness in the gradation group on the intermediate brightness side with an intermediate visibility can be set to an appropriate difference in brightness in accordance with the visibility.

Also, in the invention, when sixteen levels of gradation are divided into three gradation groups, each brightness difference in the $2^{n-1}$-gradation group on the low brightness side, the $2^{n-2}$-gradation group on the intermediate brightness side and the $2^{n-1}$-gradation group on the high brightness side is reduced successively from the $2^{n-1}$-gradation group on the high brightness side toward the $2^{n-2}$- gradation group on the intermediate brightness side and the $2^{n-2}$-gradation group on the low brightness side.

DESCRIPTION OF THE PREFERRED EMBODIMENTS

First Embodiment

Figure 1:
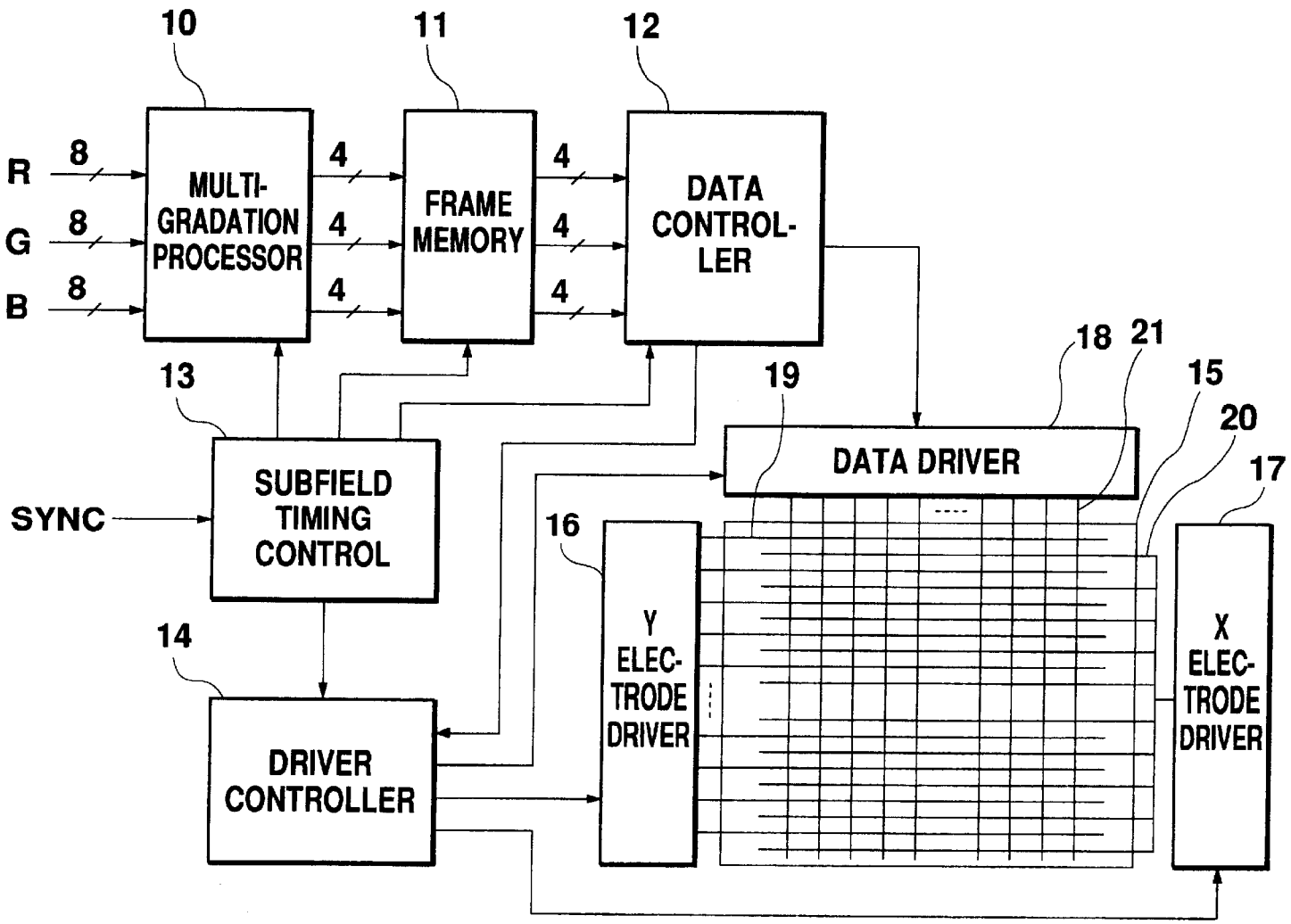
Fig. 1 PRIOR ART
FIG. 1 is a schematic diagram showing a constitution of a prior-art PDP.
Figure 2:
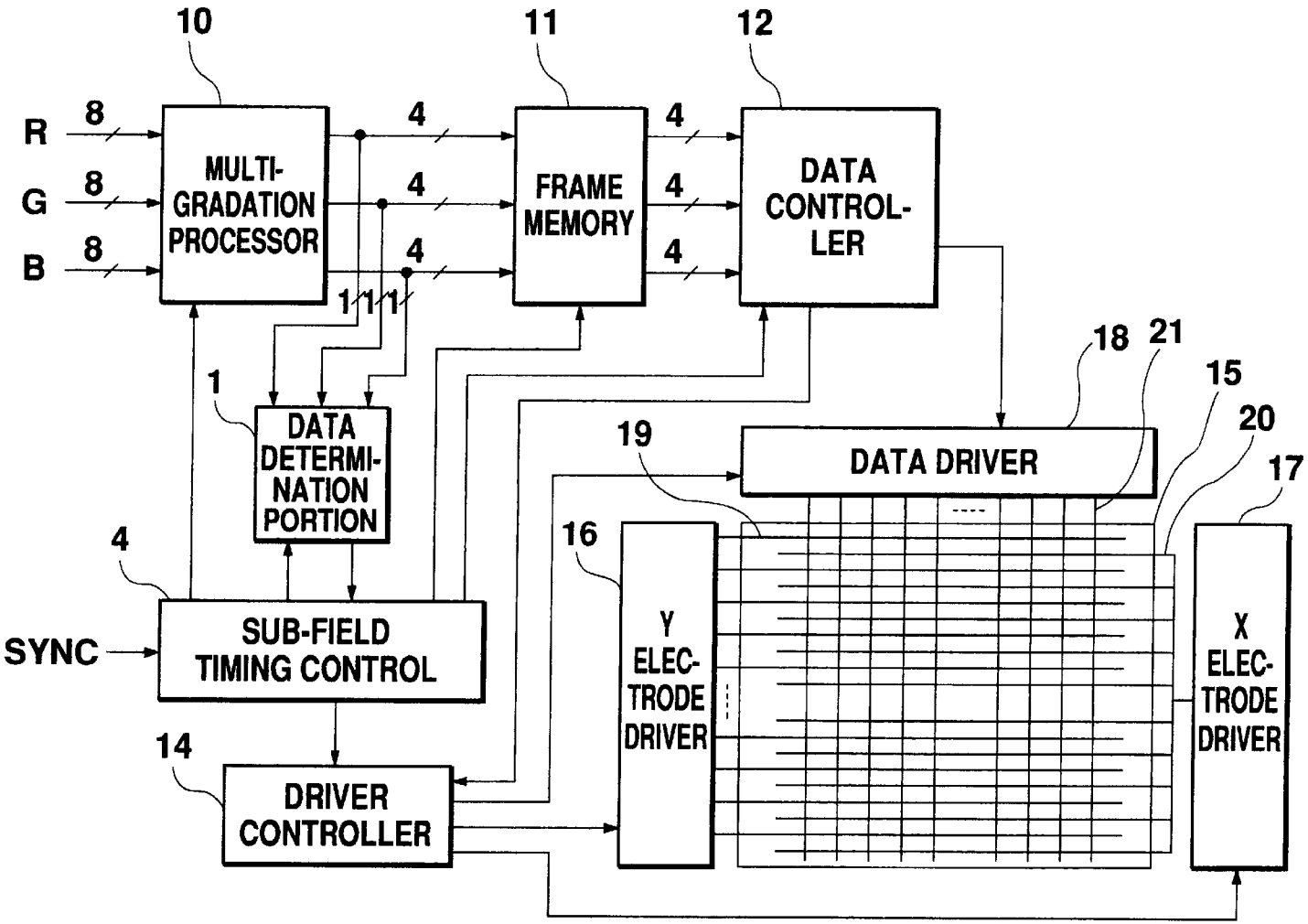
FIG. 2 is a schematic diagram showing a constitution of a PDP according to a first embodiment of the invention.

FIG. 2 shows a constitution of a PDP according to a first embodiment. For example, each of original image data of 8 bits R, G and B is supplied to the multi-gradation processor 10 in which an error diffusion process is performed, and is converted to predetermined bits, for example, four bits of data. The converted original image data is temporarily stored in a frame memory 11, while a most significant bit is supplied to a data determination portion 1 according to the invention. The data determination portion 1 determines from the most significant bit of the original image data to which region of plural, for example, two divided gradation groups the original image data belongs. A determination signal produced in the data determination portion 1 is supplied to a subfield timing control portion 4 according to the invention. In the subfield timing control portion 4, to realize a characteristic of gradation and display brightness associated with the two divided gradation groups, subfield data is prepared. Based on the determination signal transmitted from the data determination portion 1, a display brightness region including the original image data is determined. The corresponding subfield data is supplied to the frame memory 11, and stored in a form associated with the four bits of original image data.

To a data controller 12, each bit of the original image data stored in the frame memory 11 is supplied in a form associated with the subfield data obtained by the subfield timing control portion 4. Pixel data is then prepared and supplied to a data driver 18 of a PDP display portion 15.

On the other hand, a horizontal, vertical synchronous signal SYNC separated from a composite video signal is transmitted to the subfield timing control portion 4, in which signal pulses for controlling a frame period, a field period, a subfield period and column and row timings are prepared and then supplied to the multi-gradation processor 10, the frame memory 11, the data controller 12 and a driver controller 14. The driver controller 14 controls the driving of a Y electrode driver 16, an X electrode driver 17 and a data driver 18 to control the frame period, the field period, the subfield period and the column and row timings in an address period and a maintenance discharge period in each subfield period. Also, the data driver 18 is subject to a timing control from the driver controller 14, and, based on the pixel data transmitted from the data controller 12, supplies a signal voltage to the PDP display portion 15 in the subfield period to light the pixel designated in a matrix manner.

Figure 3:
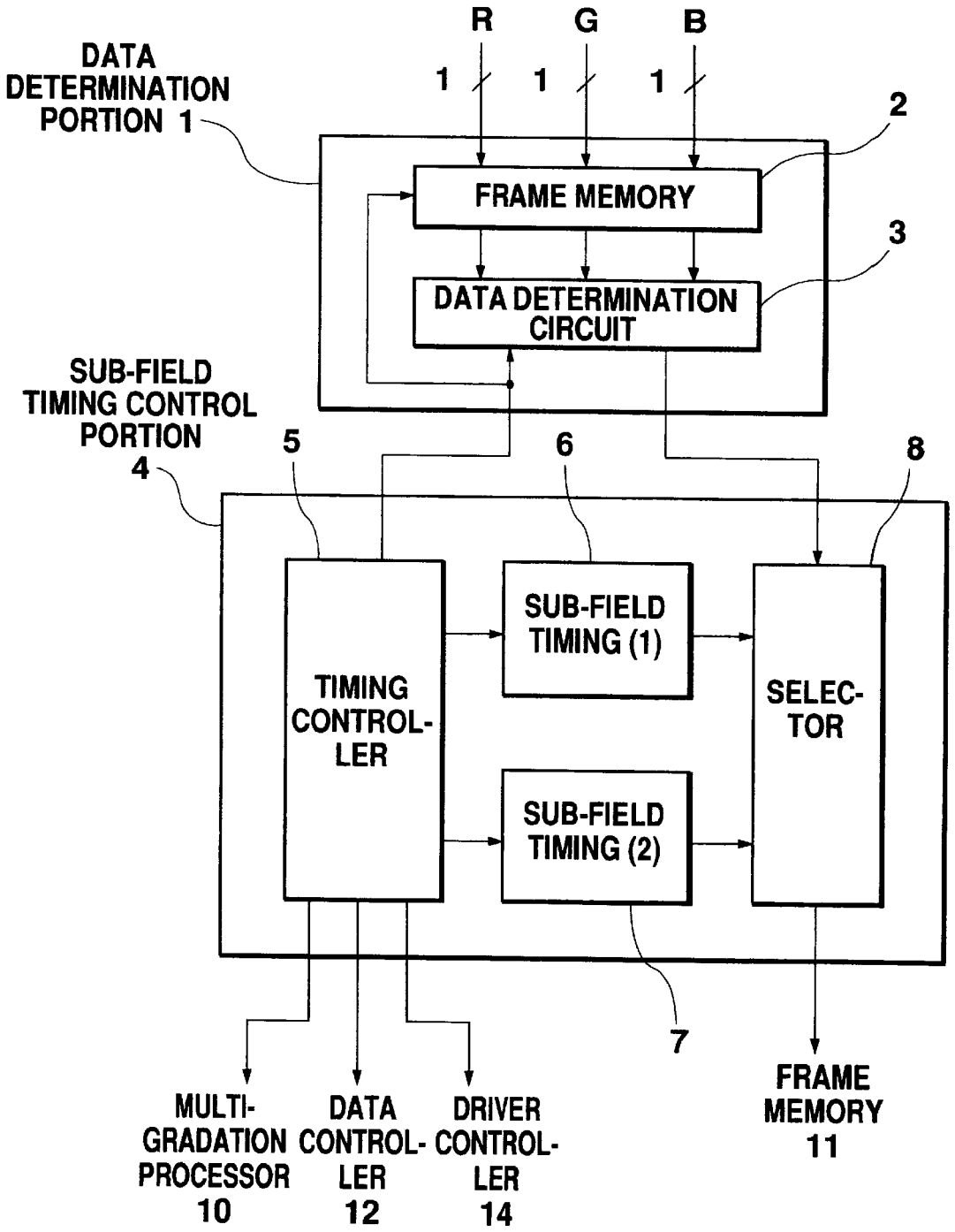
FIG. 3 is a schematic diagram showing a constitution of a data determination portion and a subfield timing control portion in FIG. 2.

FIG. 3 shows a detailed constitution of the data determination portion 1 and the subfield timing control portion 4. The data determination portion 1 is constituted of a frame memory 2 and a data determination circuit 3. The subfield timing control portion 4 is constituted of a timing controller 5, first and second subfield timing circuits 6, 7 and a selector circuit 8.

The most significant bits of the original image data R, G and B transmitted from the multi-gradation processor 10 are temporarily stored in the frame memory 2. Each of the most significant bits of the original image data is read by the data determination circuit 2, which by determining whether the bit is one or zero, determines in which one of the two divided, high-order and low-order gradation groups the original image data is included. Specifically, when the most significant bit is zero, a low-order region is determined. When the most significant bit is one, a high-order region is determined. The determination signal is transmitted to the selector circuit 8 of the subfield timing control portion 4.

On the other hand, for the subfield timing control portion 4, in the timing controller 5, based on the horizontal, vertical synchronous signal SYNC supplied from the outside, frame, field, subfield, line, dot and various other timing pulses are prepared and supplied to the multi-gradation processor 10, the frame memory 11, the data controller 12 and the driver controller 14.

The timing controller 5 also controls timings of the first and second subfield timing circuits 6 and 7. The first and second subfield timing circuits 6 and 7, being controlled by the timing controller 5, read subfield data corresponding to the high and low-order gradation groups from the subfield timing information prepared in ROM and the like, and supply the data to the selector circuit 8. In the ROM, subfield timing control data of a first subfield SF0, a second subfield SF1, a third subfield SF2, a fourth subfield SF3 and a fifth subfield SF4 are held. In these first to fifth subfields SF0, SF1, SF2, SF3 and SF4, a relative ratio of lengths of maintenance discharge periods of the subfields is set as 2:4:8:16:17. In the first subfield timing circuit 6 prepared is first subfield data constituted of the timing control data of the first subfield SF0, the second subfield SF1, the third subfield SF2 and the fifth subfield SF4. In the second subfield timing control circuit 7 prepared is second subfield data constituted of the timing control data of the second subfield SF1, the third subfield SF2, the fourth subfield SF3 and the fifth subfield SF4. Specifically, the first and second subfield data are constituted by selectively designating the aforementioned combinations of four subfield data from five subfield timing control data, to achieve driving in a four-bit/five-subfield system. The selector circuit 8 receives the determination signal of the gradation group transmitted from the data determination portion 1, selects either subfield data, and sends the data to the frame memory 11. In the frame memory 11, the subfield data is related with the four bits of original image data and stored. Specifically, by determining whether the four bits of original image data belongs to the high or low-order gradation groups, the data is related with the predetermined combination of subfields.

Table 1 shows gradations of the original image data in the four-bit/five-subfield system according to the invention, the corresponding combinations of subfields, brightnesses and brightness relative ratios.

TABLE 1

| | | FIRST EMBODIMENT 4-BIT/5-SUBFIELD SYSTEM | | | | | | COMPARATIVE EXAMPLE 4-BIT/4-SUBFIELD SYSTEM | | | | |
|---|---|---|---|---|---|---|---|---|---|---|---|---|
| | GRADA. | SF 0 | SF 1 | SF 2 | SF 3 | SF 4 | BRIGHT. (RELATIVE RATIO %) | SF 0 | SF 1 | SF 2 | SF 3 | BRIGHT. (RELATIVE RATIO %) |
| 1 | 0000 | 0 | 0 | 0 | 0 | 0 | 0 (0) | 0 | 0 | 0 | 0 | 0 (0) |
| 2 | 0001 | 1 | 0 | 0 | 0 | 0 | 2 (4.4) | 1 | 0 | 0 | 0 | 2 (6.8) |
| 3 | 0010 | 0 | 1 | 0 | 0 | 0 | 4 (8.9) | 0 | 1 | 0 | 0 | 4 (13.3) |
| 4 | 0011 | 1 | 1 | 0 | 0 | 0 | 6 (13.3) | 1 | 1 | 0 | 0 | 6 (20.0) |
| 5 | 0100 | 0 | 0 | 1 | 0 | 0 | 8 (17.8) | 0 | 0 | 1 | 0 | 8 (26.7) |
| 6 | 0101 | 1 | 0 | 1 | 0 | 0 | 10 (22.2) | 1 | 0 | 1 | 0 | 10 (33.3) |
| 7 | 0110 | 0 | 1 | 1 | 0 | 0 | 12 (26.7) | 0 | 1 | 1 | 0 | 12 (40.0) |
| 8 | 0111 | 1 | 1 | 1 | 0 | 0 | 14 (31.1) | 1 | 1 | 1 | 0 | 14 (46.7) |
| 9 | 1000 | 0 | 0 | 0 | 0 | 1 | 17 (37.8) | 0 | 0 | 0 | 1 | 16 (53.3) |
| 10 | 1001 | 0 | 1 | 0 | 0 | 1 | 21 (46.7) | 1 | 0 | 0 | 1 | 18 (60.0) |
| 11 | 1010 | 0 | 0 | 1 | 0 | 1 | 25 (55.6) | 0 | 1 | 0 | 1 | 20 (66.7) |
| 12 | 1011 | 0 | 1 | 1 | 0 | 1 | 29 (64.4) | 1 | 1 | 0 | 1 | 22 (73.3) |
| 13 | 1100 | 0 | 0 | 0 | 1 | 1 | 33 (73.3) | 0 | 0 | 1 | 1 | 24 (80.0) |
| 14 | 1101 | 0 | 1 | 0 | 1 | 1 | 37 (82.2) | 1 | 0 | 1 | 1 | 26 (86.7) |
| 15 | 1110 | 0 | 0 | 1 | 1 | 1 | 41 (91.1) | 0 | 1 | 1 | 1 | 28 (93.3) |
| 16 | 1111 | 0 | 1 | 1 | 1 | 1 | 45 (100.0) | 1 | 1 | 1 | 1 | 30 (100.0) |

Also, as a comparative example, the same values of a prior-art four-bit/four-subfield system are shown. As shown in the table, in the first embodiment, for display of 16 gradations by means of four bits of the original image data, four subfields SF0, SF1, SF2 and SF4 in low-order eight gradations on a low brightness side are selected, based on the first subfield data. Each bit of the original image data is allocated to each of the subfields. Four subfields SF1, SF2, SF3 and SF4 in high-order eight gradations on a high brightness side, are selected based on the second subfield data. Each bit of the original image data is allocated to each of the subfields. Thereby, there is a difference of 2 in brightness between the gradations from the first to eighth gradations, a difference of 3 between the eighth gradation and the ninth gradation, and a difference of 4 in brightness between the gradations from the ninth to sixteenth gradations. On the other hand, in the comparative example, from the first to sixteenth gradations, there is a constant difference of 2 in brightness between the gradations.

Figure 4:
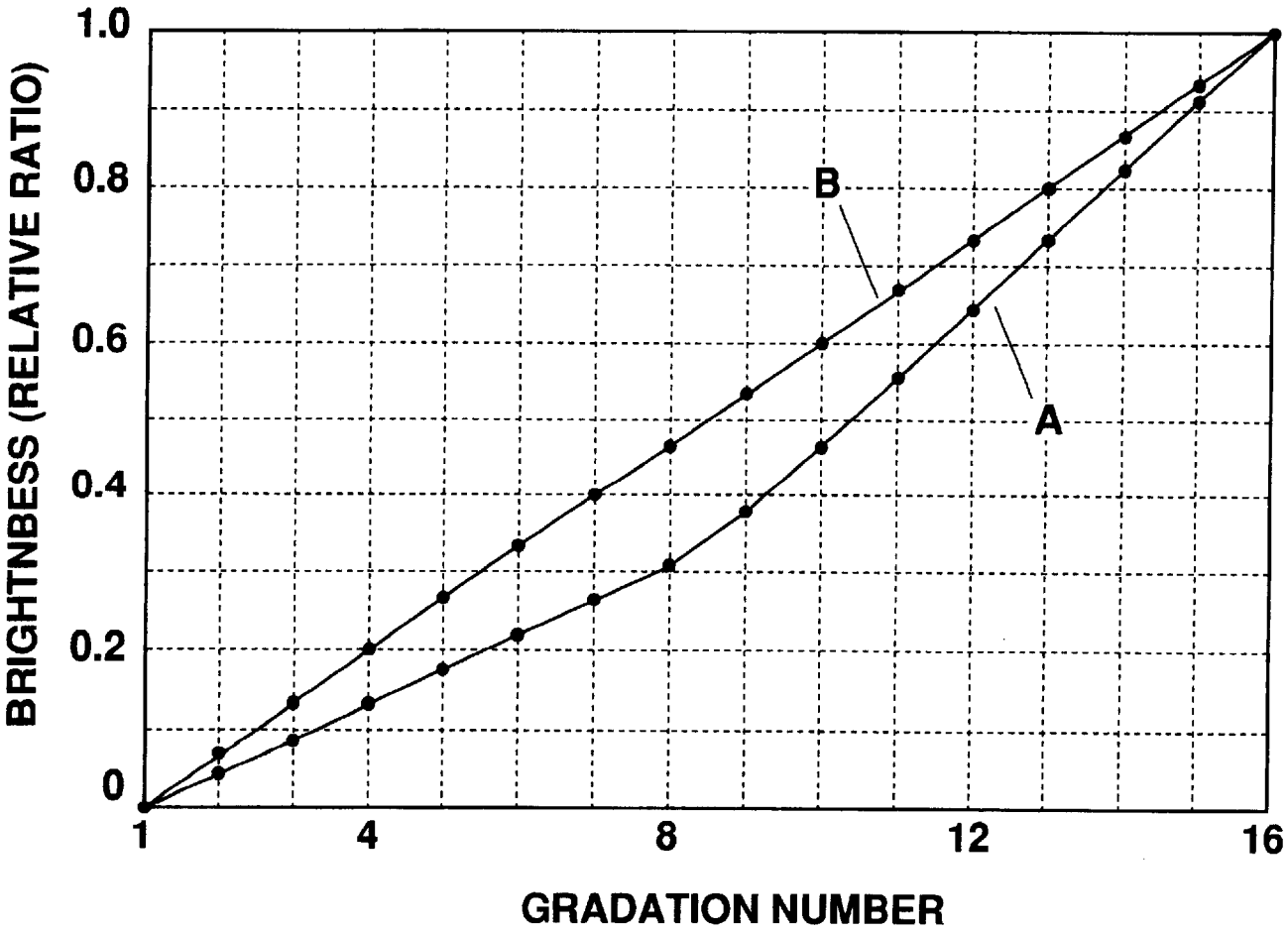
FIG. 4 is a graph showing a relationship between a gradation and a display brightness in the PDP according to the first embodiment.

In FIG. 4, the relationships between the gradation and the brightness obtained from Table 1 are shown by characteristic curves A and B for the first embodiment and the comparative example, respectively. The axis of abscissa represents a gradation number, and the axis of ordinate represents the relative ratio of brightness. As shown by the curve A, the first to eighth gradations differ in gradient of the characteristic curve from the ninth to sixteenth gradations. Specifically, the difference in brightness between the gradations in the low brightness region including the first to eighth gradations is smaller than the difference in brightness between the gradations in the high brightness region including the ninth to sixteenth gradations.

On the other hand, as shown by the curve B, in the prior art, the curve indicating the relationship between the gradation and the brightness is straightened. The brightness changes in direct proportion to the gradation. Originally in the low brightness region, the human visibility is high, and in the high brightness region, the human visibility is low. Therefore, when display is performed under the gradation control as shown by the characteristic curve B, in the low brightness region, the difference in brightness between the gradations seems to be large, and in the high brightness region, the difference in brightness between the gradations seems to be small. Therefore, a clear image cannot be observed over all the brightness regions. To solve this problem, in the first embodiment, by reducing the difference in brightness between the gradations in the low brightness region and enlarging the difference in brightness between the gradations in the high brightness region, the difference in brightness between the gradations is uniformly recognized over all the brightness regions in such a manner that the display characteristic is compensated by the human sensitivity. A clear image with no variety of difference in brightness can be observed.

Figure 5:
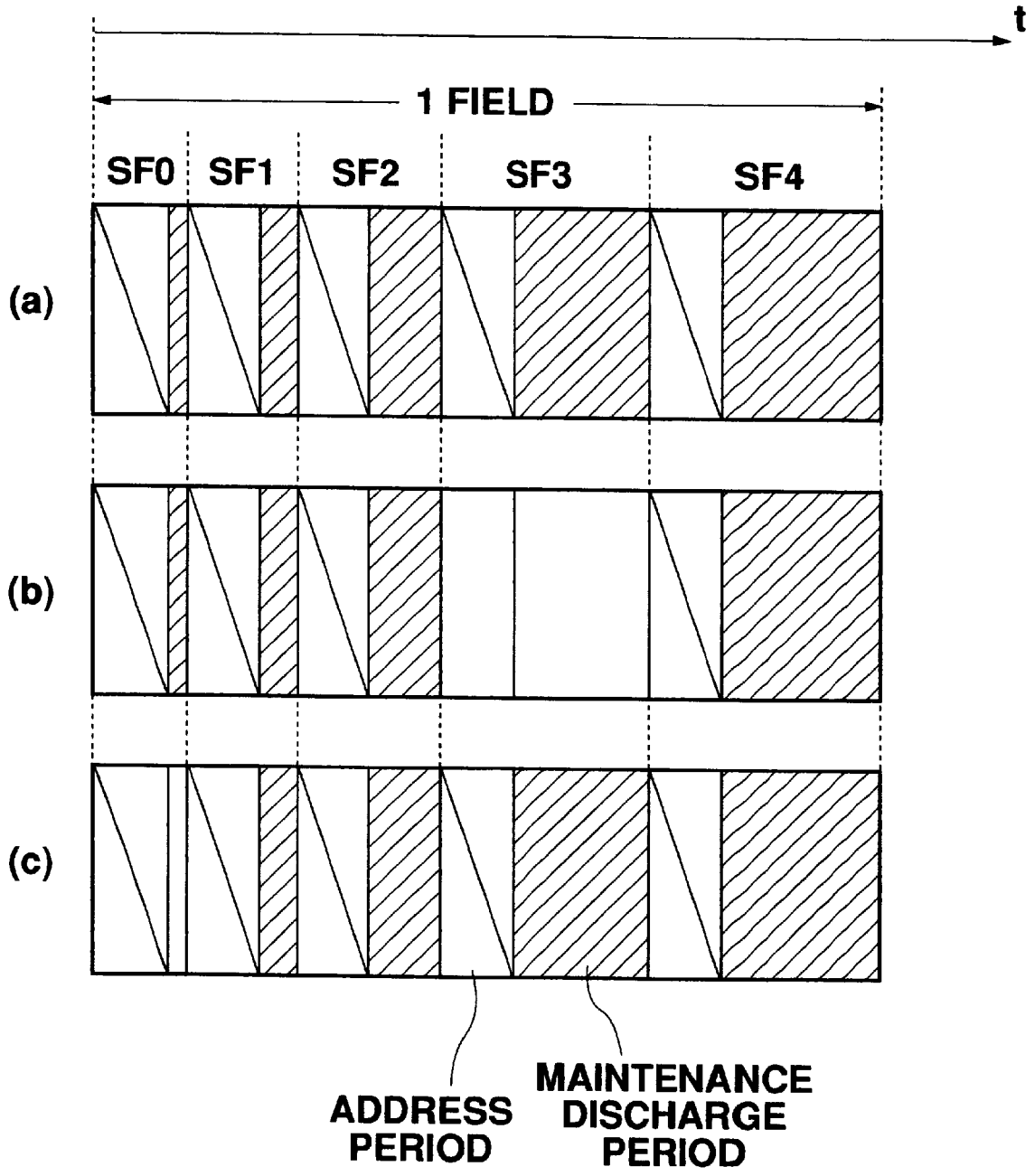
FIG. 5 shows combinations of subfields in a method of driving the PDP according to the first embodiment.

FIG. 5 shows constitutions of one field in the PDP driving method according to the embodiment. (a) in FIG. 5 shows a constitution of one field prepared in the timing controller 5. The field is constituted of five subfields SF0, SF1, SF2, SF3 and SF4 which have the address period and the maintenance discharge period. These subfields SF0, SF1, SF2, SF3 and SF4 have different lengths of the maintenance charge periods, to indicate desired brightness ratios. The length of the maintenance charge period corresponds to the length of the lighting time, and is associated with the brightness. The relative ratio of lighting time of the subfields SF0, SF1, SF2, SF3 and SF4 is set as 2:4:8:16:17.

(b) shown in FIG. 5 shows one field constituted of four subfields SF0, SF1, SF2 and SF4 to which each bit of the original image data including the first to eighth gradations is allocated. (c) in FIG. 5 shows one field constituted of four subfields SF1, SF2, SF3 and SF4 to which each bit of the original image data including the ninth to sixteenth gradations is allocated. Specifically, in one field constituted beforehand of five subfields as shown in (a) of FIG. 5, in accordance with the gradations to be displayed, four subfields are selectively prepared as shown in (b) or (c) of FIG. 5, to perform a gradation display by controlling lighting and non-lighting.

Second Embodiment

Figure 6:
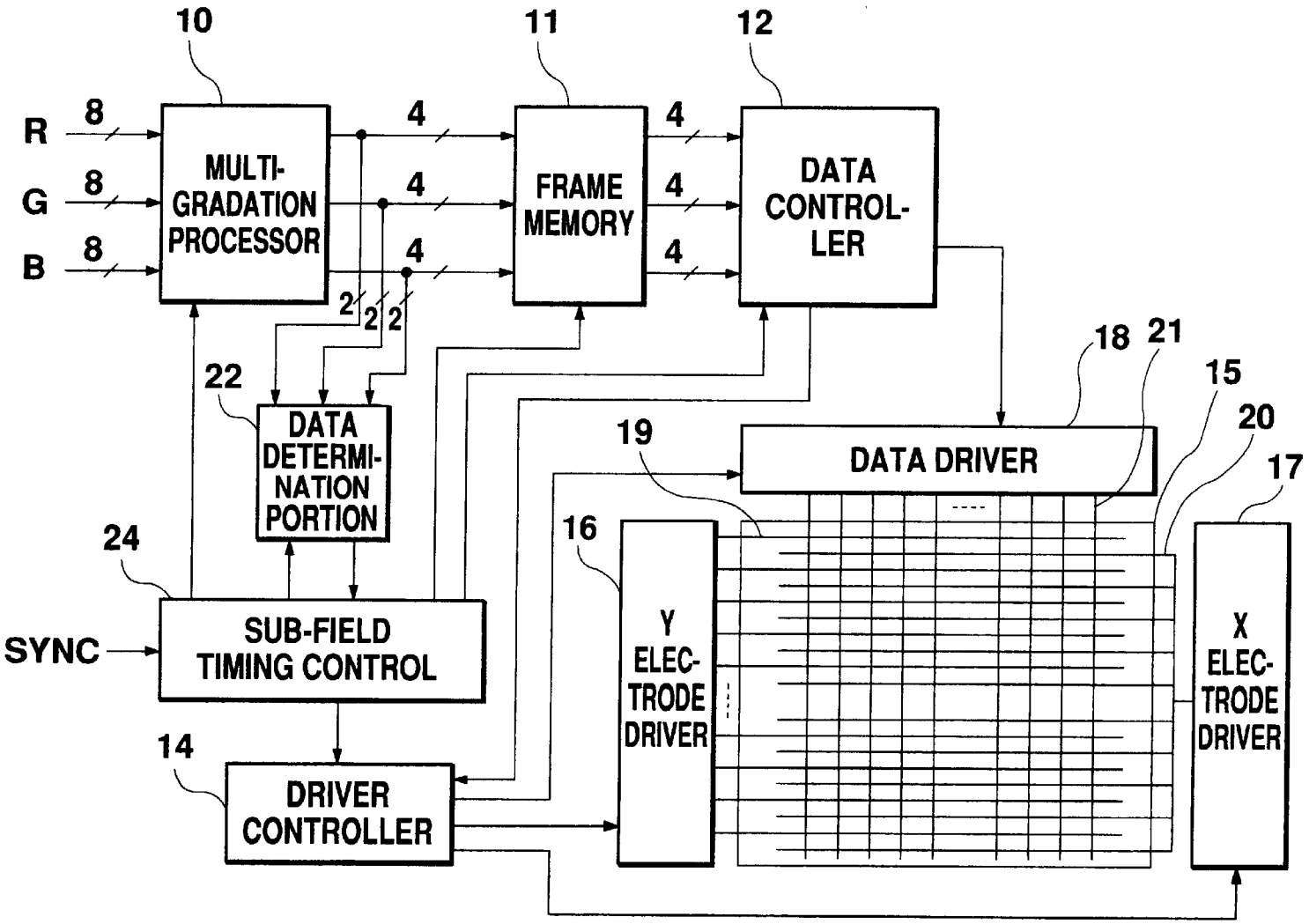
FIG. 6 is a schematic diagram showing a constitution of a PDP according to a second embodiment.

FIG. 6 shows a constitution of a PDP according to a second embodiment of the invention. In the following, a portion corresponding to the structure described in the first embodiment is denoted with the same numerals in the figure, and the description thereof is omitted. The four bits original image data converted in the multi-gradation processor 10 is temporarily stored in the frame memory 11, and simultaneously, in this embodiment, the upper two bits of the image data of four bits transmitted from the multi-gradation processor 10 are supplied to a data determination portion 22 according to the invention. The data determination portion 22 determines from the upper two bits of the original image data to which region of three divided low-order, intermediate-order and high-order gradation groups the original image data belongs. A determination signal produced in the data determination portion 22 is supplied to a subfield timing control portion 24 according to the second embodiment. In the subfield timing control portion 24, to realize a characteristic of gradation and display brightness associated with the three divided gradation groups, subfield data is prepared. Based on the determination signal transmitted from the data determination portion 22, a display brightness region including the original image data is determined. The corresponding subfield data is supplied to the frame memory 11, and stored in the frame memory 11 in a form associated with the four bits of original image data.

Figure 7:
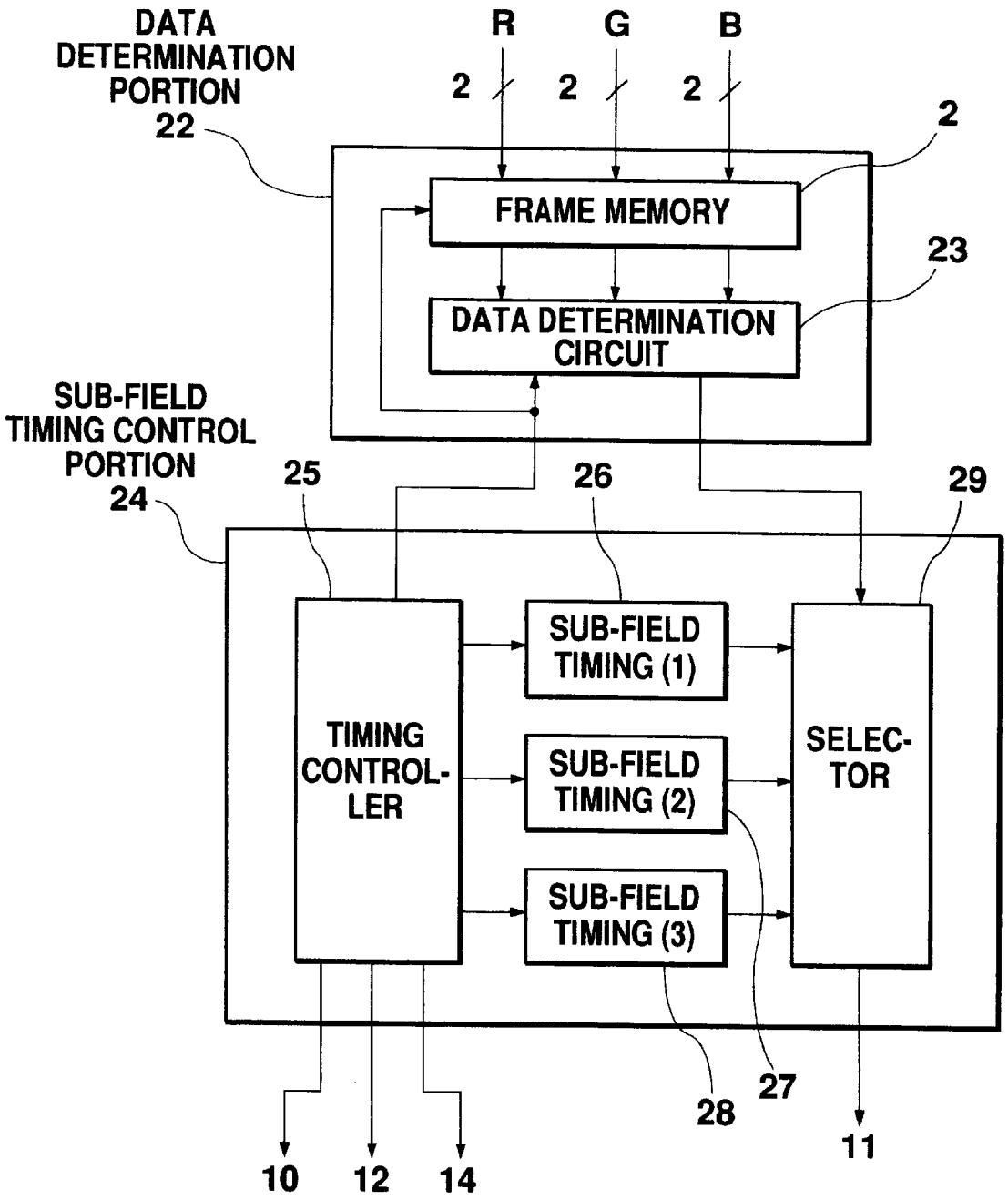
FIG. 7 is a schematic diagram showing a constitution of a data determination portion and a subfield timing control portion in FIG. 6.

FIG. 7 shows a detailed constitution of the data determination portion 22 and the subfield timing control portion 24 according to the second embodiment. The data determination portion 22 is constituted of the frame memory 2 and a data determination circuit 23. The subfield timing control portion 24 is constituted of a timing controller 25, first, second and third subfield timing circuits 26, 27, 28 and a selector circuit 29.

The upper two bits of the original image data R, G and B transmitted from the multi-gradation processor 10 are temporarily stored in the frame memory 2. The upper two bits of the original image data are read by the data determination circuit 23, which by determining the upper two bit data is 00, 01 or 1×, determines in which one of the three divided, low-order, intermediate-order and high-order gradation groups the original image data is included. Specifically, when the upper two bits are 00, a low-order region is determined. When the two bits are 01, an intermediate-order region is determined. When the most significant bit is 1, a high-order region is determined. The determination signal is transmitted from the data determination circuit 23 to the selector circuit 29 of the subfield timing control portion 24.

On the other hand, in the subfield timing control portion 24, based on the horizontal, vertical synchronous signal SYNC supplied from the outside, the timing controller 25 prepares frame, field, subfield, line, dot and other various timing pulses, and supplies the pulses to the multi-gradation processor 10, the frame memory 11, the data controller 12 and the driver controller 14.

The timing controller 25 also controls timings of the first, second and third subfield timing circuits 26. 27 and 28. The first, second and third subfield timing circuits 26, 27 and 28, being controlled by the timing controller 25, read subfield data corresponding to the low, intermediate and high-order gradation groups from the subfield timing information prepared by ROM and the like, and supply the data to the selector circuit 29. In the ROM, subfield timing control data of a first subfield SF0, a second subfield SF1, a third subfield SF2, a fourth subfield SF3, a fifth subfield SF4 and a sixth subfield SF5 are held. In these first to sixth subfields SF0, SF1, SF2, SF3, SF4 and SF5, a relative ratio of lengths of maintenance discharge periods of the subfields is set as 1:2:4:16:5:14. In the first subfield timing circuit 26 prepared is a first subfield data constituted of the timing control data of the first subfield SF0, the second subfield SF1, the third subfield SF2 and the sixth subfield SF5. In the second subfield timing circuit 27 second subfield data is prepared, constituted of the timing control data of the second subfield SF1, the third subfield SF2, the fifth subfield SF4 and the sixth subfield SF5. In the third subfield timing circuit 28 third subfield data is prepared, constituted of the first subfield SF0, the second subfield SF1, the third subfield SF2, the fourth subfield SF3, the fifth subfield SF4 and the sixth subfield SF5. Specifically, the first, second and third subfield data are constituted by selectively designating the aforementioned combinations of four or all subfield data from six subfield timing control data, to achieve driving in a four-bit/six-subfield system. The selector circuit 29 receives the determination signal of the gradation group transmitted from the data determination portion 22, selects either subfield data, and sends the data to the frame memory 11. In the frame memory 11, the subfield data is related with the four bits of original image data and stored. Specifically, by determining whether the four bits of original image data belongs to the low, intermediate or high-order gradation groups, the data is related with the predetermined combination of subfields.

Table 2 shows gradations of the original image data in the four-bit/six-subfield system according to the second embodiment, the corresponding combinations of subfields, brightnesses and brightness relative ratios.

TABLE 2

| | | SECOND EMBODIMENT 4-BIT/6-SUBFIELD SYSTEM | | | | | | | COMPARATIVE EXAMPLE 4-BIT/4-SUBFIELD SYSTEM | | | | |
|---|---|---|---|---|---|---|---|---|---|---|---|---|---|
| | GRADA. | SF 0 | SF 1 | SF 2 | SF 3 | SF 4 | SF 5 | BRIGHT. (RELA. RATIO %) | SF 0 | SF 1 | SF 2 | SF 3 | BRIGHT. (RELATIVE RATIO %) |
| 1 | 0000 | 0 | 0 | 0 | 0 | 0 | 0 | 0 (0) | 0 | 0 | 0 | 0 | 0 (0) |
| 2 | 0001 | 1 | 0 | 0 | 0 | 0 | 0 | 1 (2.4) | 1 | 0 | 0 | 0 | 2 (6.7) |
| 3 | 0010 | 0 | 1 | 0 | 0 | 0 | 0 | 2 (4.8) | 0 | 1 | 0 | 0 | 4 (13.3) |
| 4 | 0011 | 1 | 1 | 0 | 0 | 0 | 0 | 3 (7.1) | 1 | 1 | 0 | 0 | 6 (20.0) |
| 5 | 0100 | 0 | 0 | 0 | 0 | 1 | 0 | 5 (11.9) | 0 | 0 | 1 | 0 | 8 (26.7) |

TABLE 2-continued

| | | SECOND EMBODIMENT 4-BIT/6-SUBFIELD SYSTEM | | | | | | | COMPARATIVE EXAMPLE 4-BIT/4-SUBFIELD SYSTEM | | | | |
|---|---|---|---|---|---|---|---|---|---|---|---|---|---|
| | GRADA. | SF 0 | SF 1 | SF 2 | SF 3 | SF 4 | SF 5 | BRIGHT. (RELA. RATIO %) | SF 0 | SF 1 | SF 2 | SF 3 | BRIGHT. (RELATIVE RATIO %) |
| 6 | 0101 | 0 | 1 | 0 | 0 | 1 | 0 | 7 (16.7) | 1 | 0 | 1 | 0 | 10 (33.3) |
| 7 | 0110 | 0 | 0 | 1 | 0 | 1 | 0 | 9 (21.4) | 0 | 1 | 1 | 0 | 12 (40.0) |
| 8 | 0111 | 0 | 1 | 1 | 0 | 1 | 0 | 11 (26.2) | 1 | 1 | 1 | 0 | 14 (46.7) |
| 9 | 1000 | 0 | 0 | 0 | 0 | 0 | 1 | 14 (33.3) | 0 | 0 | 0 | 1 | 16 (53.3) |
| 10 | 1001 | 0 | 0 | 1 | 0 | 0 | 1 | 18 (42.9) | 1 | 0 | 0 | 1 | 18 (60.0) |
| 11 | 1010 | 1 | 1 | 0 | 0 | 1 | 1 | 22 (52.4) | 0 | 1 | 0 | 1 | 20 (66.7) |
| 12 | 1011 | 1 | 1 | 1 | 0 | 1 | 1 | 26 (61.9) | 1 | 1 | 0 | 1 | 22 (73.3) |
| 13 | 1100 | 0 | 0 | 0 | 1 | 0 | 1 | 30 (71.4) | 0 | 0 | 1 | 1 | 24 (80.0) |
| 14 | 1101 | 0 | 0 | 1 | 1 | 0 | 1 | 34 (81.0) | 1 | 0 | 1 | 1 | 26 (86.7) |
| 15 | 1110 | 1 | 1 | 0 | 1 | 1 | 1 | 38 (90.5) | 0 | 1 | 1 | 1 | 28 (93.3) |
| 16 | 1111 | 1 | 1 | 1 | 1 | 1 | 1 | 42 (100.) | 1 | 1 | 1 | 1 | 30 (100.0) |

Also, as a comparative example, in the same manner as in Table 1, the same values of the prior-art four-bit/four-subfield system are shown. As shown in the table, in the second embodiment, for display of 16 gradations by means of four bits of the original image data, four subfields SF0, SF1, SF2 and SF5 are selected from among the low-order gradations on a low brightness side, based on the first subfield data. Each bit of the original image data is allocated to each of the subfields. From the intermediate-order four gradations, four subfields SF1, SF2, SF4 and SF5 are selected based on the second subfield data. Each bit of the original image data is allocated to each of the subfields. From the high-order eight gradations on a high brightness side, all the subfields SF0, SF1, SF2, SF3, SF4 and SF5 are selected, based on the third subfield data. The first bit of the original image data is allocated to the third subfield SF2, the second bit is allocated to the first, second and fifth subfields SF0, SF1 and SF4, the third bit is allocated to the fourth subfield SF3, and the fourth bit is allocated to the sixth subfield SF5. Thereby, there is a difference of 1 in brightness between the gradations from the first to fourth gradations, a difference of 2 in brightness between the gradations from the fourth to eighth gradations, a difference of 3 between the eighth gradation and the ninth gradation, and a difference of 4 in brightness between the gradations from the ninth to sixteenth gradations. On the other hand, in the comparative example, from the first to sixteenth gradations, there is a constant difference of 2 in brightness between the gradations.

Figure 8:
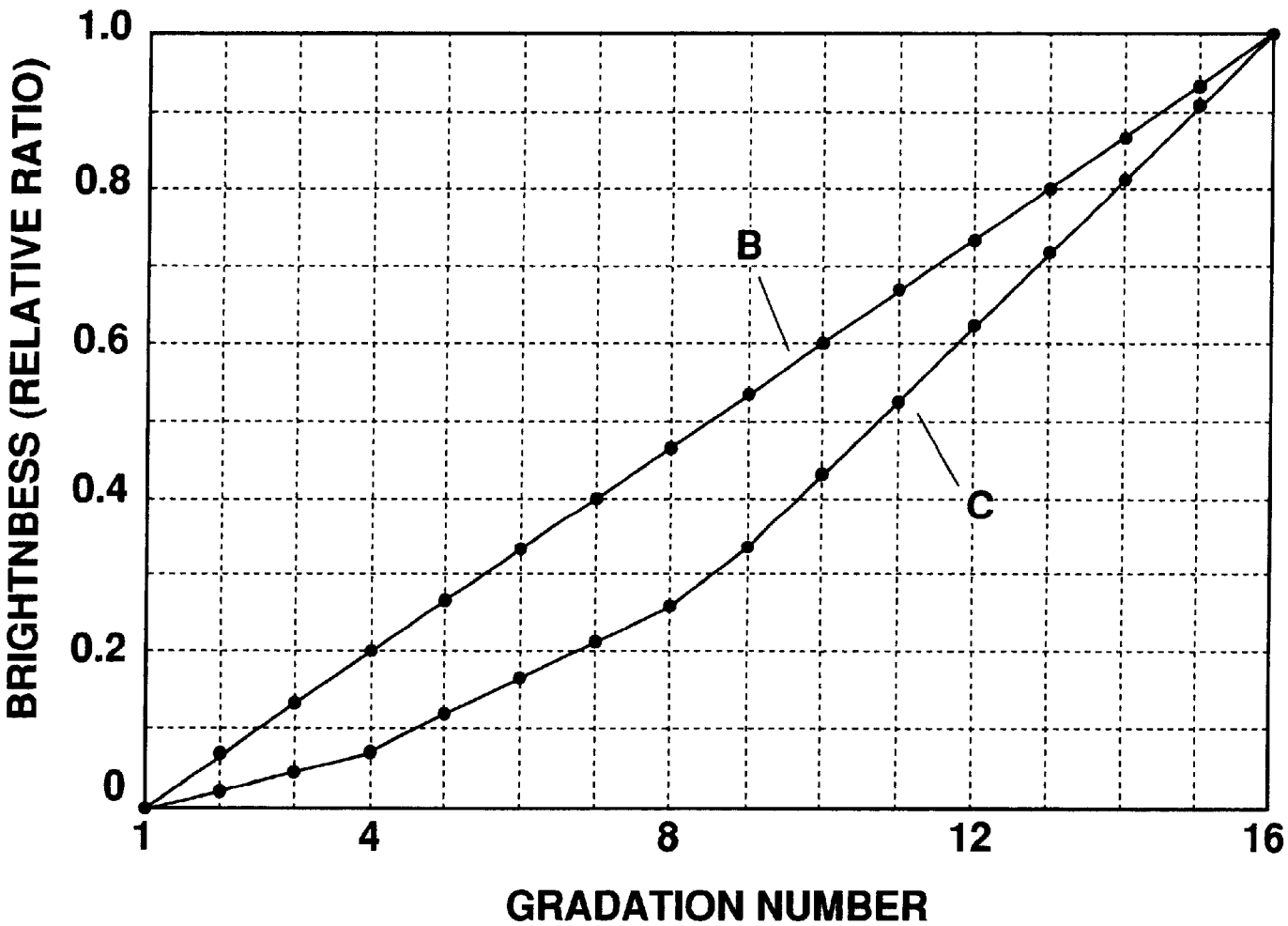
FIG. 8 is a graph showing a relationship between a gradation and a display brightness in the PDP according to the second embodiment.

In FIG. 8, the relationships between the gradation and the brightness obtained from Table 2 are shown by characteristic curves B and C for the second embodiment and the comparative example, respectively. The axis of abscissa represents a gradation number, and the axis of ordinate represents the relative ratio of brightness. As shown by the curve C, in the second embodiment, a low-order region including the first to fourth gradations, an intermediate-order region including the fourth to eighth gradations and a high-order region including the ninth to sixteenth gradations differ from one another in gradient of the characteristic curve. Specifically, the difference in brightness between the gradations in the low brightness region including the first to fourth gradations is smaller than the difference in brightness between the gradations in the high brightness region including the ninth to sixteenth gradations.

On the other hand, as shown by the curve B which is the same as the curve B of FIG. 4, in the prior art, the curve indicating the relationship between the gradation and the brightness is straightened. The brightness changes in direct proportion to the gradation. Therefore, a clear image cannot be observed over all the brightness regions. To solve the problem, in the second embodiment, by reducing the difference in brightness between the gradations in the lower brightness region and enlarging the difference in brightness between the gradations in the higher brightness region, the difference in brightness between the gradations is uniformly recognized over all the brightness regions in such a manner that the display characteristic is compensated by the human sensitivity. A clear image with no compression in brightness can be observed. Also, in the second embodiment, the difference in brightness between the gradations in the low brightness region is even smaller compared with the first embodiment. Therefore, in respect of a visual characteristic, an image can be more uniformly displayed.

Figure 9:
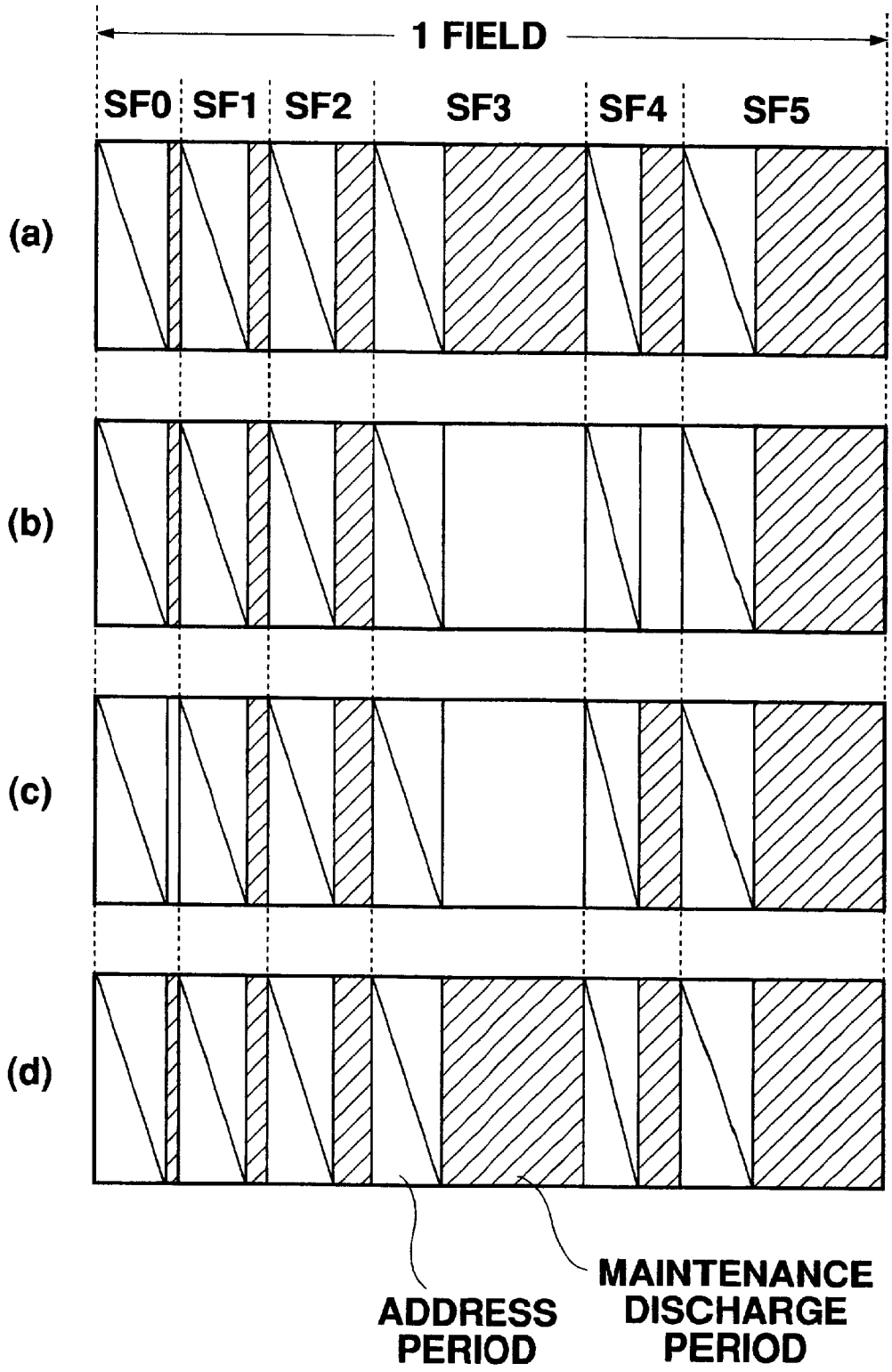
FIG. 9 shows combinations of subfields in a method of driving the PDP according to the second embodiment.

FIG. 9 shows constitutions of one field in the PDP driving method according to the second embodiment. (a) shown in FIG. 9 shows a constitution of one field prepared in the timing controller 25. The field is constituted of six subfields SF0, SF1, SF2, SF3, SF4 and SF5 which have the address period and the maintenance discharge period. These subfields SF0, SF1, SF2, SF3, SF4 and SF5 have different lengths of the maintenance charge periods to indicate desired brightness ratios. The length of the maintenance charge period corresponds to the length of the lighting time, and is associated with the brightness. The relative ratio of lighting time of the subfields SF0, SF1, SF2, SF3, SF4 and SF5 is set as 1:2:4:16:5:14.

(b) shown in FIG. 9 shows one field constituted of four subfields SF0, SF1, SF2 and SF5 to which each bit of the original image data including the first to fourth gradations is allocated. (c) shown in FIG. 9 shows one field constituted of four subfields SF1, SF2, SF4 and SF5 to which each bit of the original image data including the fifth to eighth gradations is allocated. (d) shown in FIG. 9 shows one field constituted of six subfields SF0, SF1, SF2, SF3, SF4 and SF5 to which each bit of the original image data including the ninth to sixteenth gradations is allocated. Specifically, in one field constituted beforehand of six subfields as shown in (a) of FIG. 9, four or six subfields are selectively prepared as shown in (b), (c) or (d) of FIG. 9,in accordance with the gradations to be displayed, so as to perform a gradation display by allocating each bit of the original image data to each of the subfields combined as aforementioned and controlling lighting and non-lighting.

Third Embodiment

Figure 10:
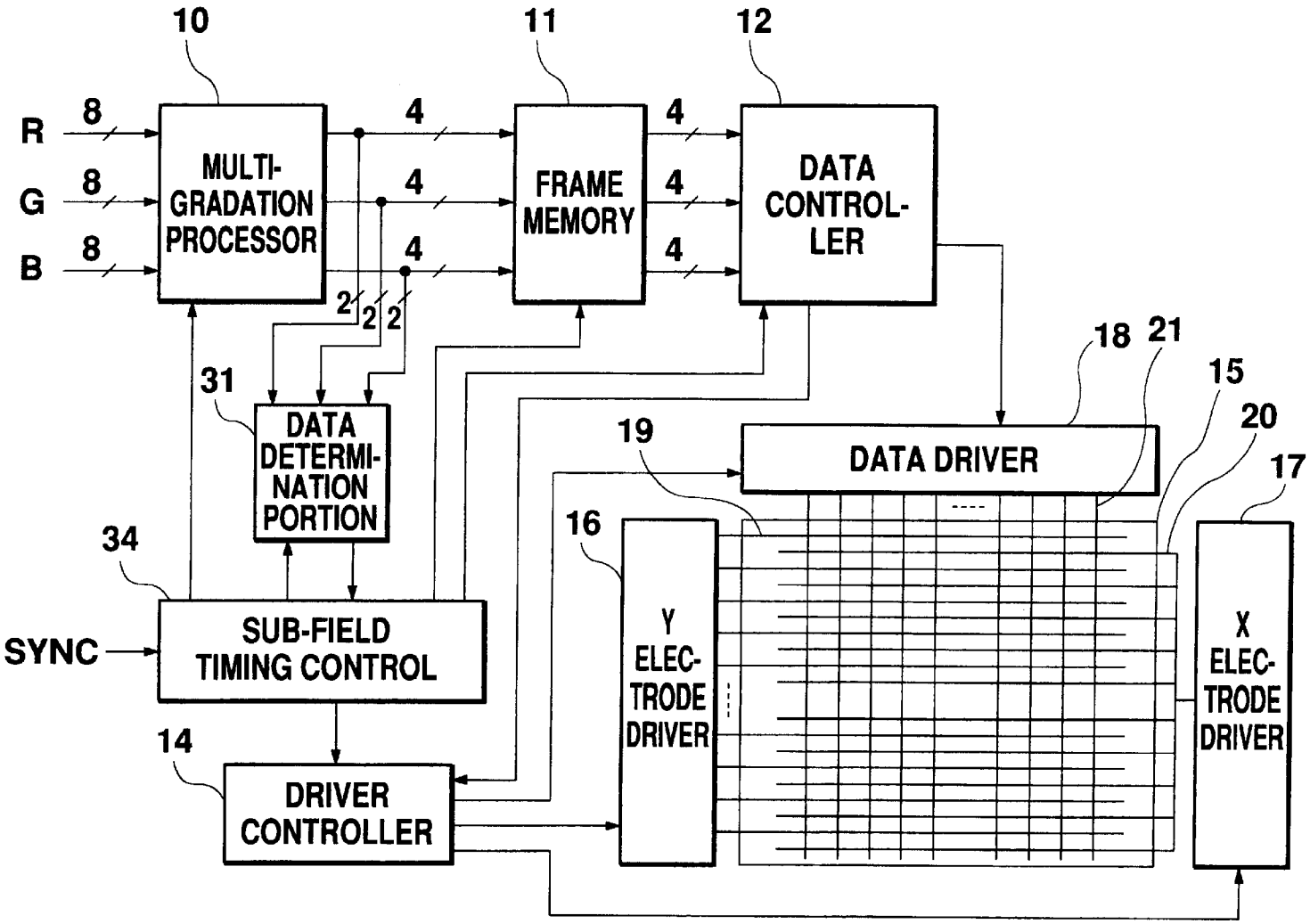
FIG. 10 is a schematic diagram showing a constitution of a PDP according to a third embodiment.

FIG. 10 shows a constitution of a PDP according to a third embodiment. Each of the original image data R, G and B of fourth bits sent from the multi-gradation processor 10 is temporarily stored in the frame memory 11, while in the same manner as the second embodiment, the upper two bits are supplied to a data determination portion 31 according to the invention. The data determination portion 31 determines from the upper two bits of the original image data to which region of three divided low-order, intermediate-order and high-order gradation groups the original image data belongs. A determination signal produced in the data determination portion 31 is supplied to a subfield timing control portion 34 according to the invention. In the subfield timing control portion 34, to realize a characteristic of gradation and display brightness associated with the three divided gradation groups, subfield data is prepared. Based on the determination signal transmitted from the data determination portion 31, a display brightness region including the original image data is determined. The corresponding subfield data is supplied to the frame memory 11, and stored in a form associated with the four bits of original image data.

Figure 11:
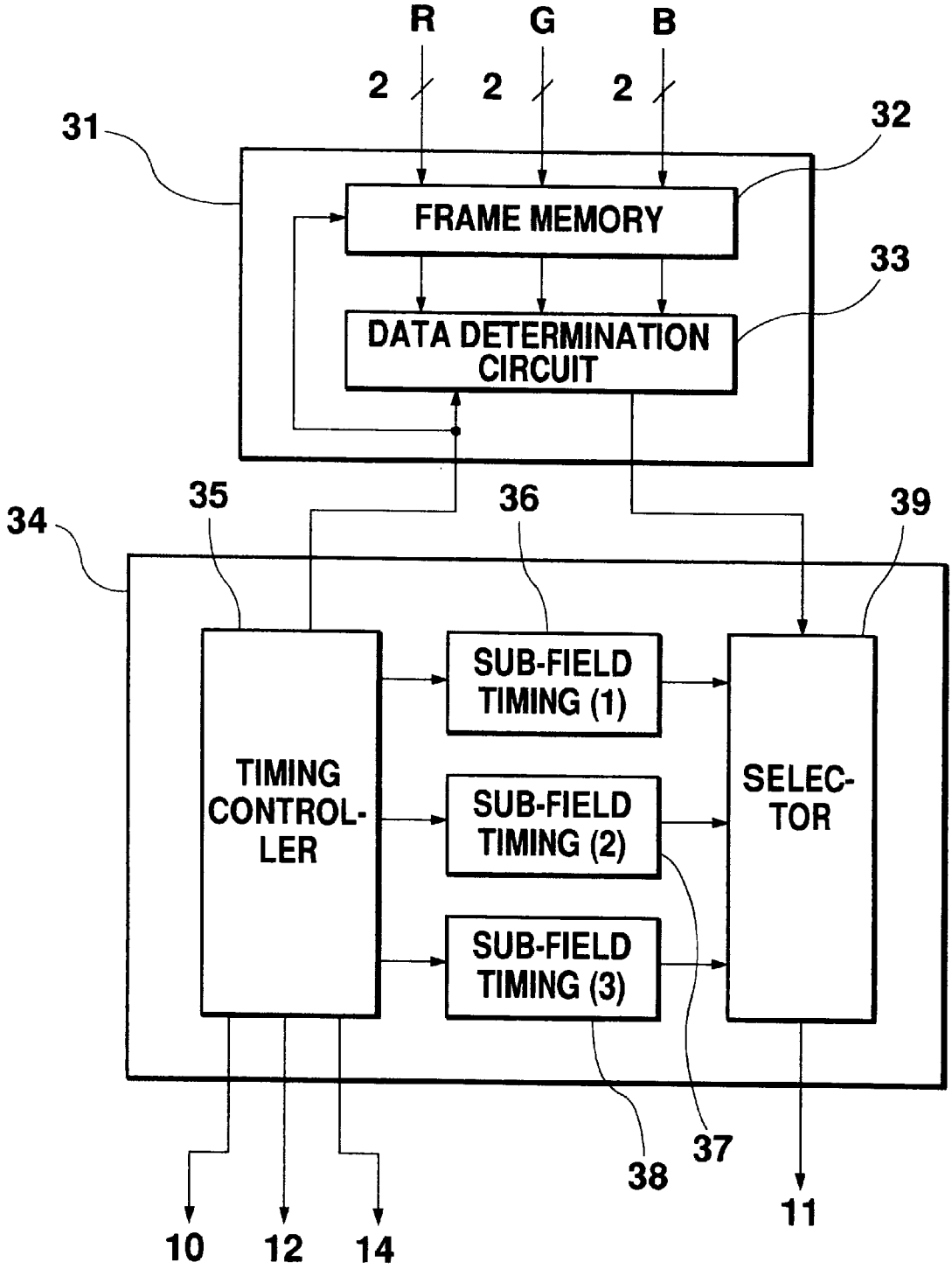
FIG. 11 is a schematic diagram showing a constitution of a data determination portion and a subfield timing control portion in FIG. 10.

FIG. 11 shows a detailed constitution of the data determination portion 31 and the subfield timing control portion 34. The data determination portion 31 is constituted of a frame memory 32 and a data determination circuit 33. The subfield timing control portion 34 is constituted of a timing controller 35, first, second and third subfield timing circuits 36, 37, 38 and a selector circuit 39.

The timing controller 35 also controls timings of the first, second and third subfield timing circuits 36. 37 and 38. The first, second and third subfield timing circuits 36, 37 and 38, being controlled by the timing controller 35, read subfield data corresponding to the low, intermediate and high-order gradation groups from the subfield timing information prepared in ROM and the like, and supply the data to the selector circuit 39. In this embodiment, subfield timing control data of a first subfield SF0, a second subfield SF1, a third subfield SF2, a fourth subfield SF3, a fifth subfield SF4, a sixth subfield SF5 and a seventh subfield SF6 are held in the ROM. In these first to seventh subfields SF0, SF1, SF2, SF3, SF4, SF5 and SF6, a relative ratio of lengths of maintenance discharge periods of the subfields is set as 1:2:4:8:16:5:14. In the first subfield timing circuit 36 first subfield data is prepared, constituted of the timing control data of the first subfield SF0, the second subfield SF1, the sixth subfield SF5 and the seventh subfield SF6. In the second subfield timing circuit 37 second subfield data is prepared, constituted of the timing control data of the second subfield SF1, the third subfield SF2, the sixth subfield SF5 and the seventh subfield SF6. In the third subfield timing circuit 38 third subfield data is prepared, constituted of the third subfield SF2, the fourth subfield SF3, the fifth subfield SF4 and the seventh subfield SF6. Specifically, the first, second and third subfield data are constituted by selectively designating the aforementioned combinations of four subfield data from seven subfield timing control data, to achieve driving in a four-bit/seven-subfield system. The selector circuit 39 receives the determination signal of the gradation group transmitted from the data determination portion 31, selects either subfield data, and sends the data to the frame memory 11. The subfield data is related with the four bits of original image data and stored. Specifically, by determining whether the four bits of original image data belongs to the low, intermediate or high-order gradation groups, the data is related with the predetermined combination of subfields.

Table 3 shows gradations of the original image data in the four-bit/seven-subfield system according to the third embodiment, the corresponding combinations of subfields, brightnesses and brightness relative ratios.

TABLE 3

| | | THIRD EMBODIMENT 4-BIT/7-SUBFIELD SYSTEM | | | | | | | | COMPARATIVE EXAMPLE 4-BIT/4-SUBFIELD SYSTEM | | | | |
|---|---|---|---|---|---|---|---|---|---|---|---|---|---|---|
| | GRADA. | SF 0 | SF 1 | SF 2 | SF 3 | SF 4 | SF 5 | SF 6 | BRIGHT. (RELA. RATIO %) | SF 0 | SF 1 | SF 2 | SF 3 | BRIGHT. (RELATIVE RATIO %) |
| 1 | 0000 | 0 | 0 | 0 | 0 | 0 | 0 | 0 | 0 (0) | 0 | 0 | 0 | 0 | 0 (0) |
| 2 | 0001 | 1 | 0 | 0 | 0 | 0 | 0 | 0 | 1 (2.4) | 1 | 0 | 0 | 0 | 2 (6.7) |
| 3 | 0010 | 0 | 1 | 0 | 0 | 0 | 0 | 0 | 2 (4.8) | 0 | 1 | 0 | 0 | 4 (13.3) |
| 4 | 0011 | 1 | 1 | 0 | 0 | 0 | 0 | 0 | 3 (7.1) | 1 | 1 | 0 | 0 | 6 (20.0) |
| 5 | 0100 | 0 | 0 | 0 | 0 | 0 | 1 | 0 | 5 (11.9) | 0 | 0 | 1 | 0 | 8 (26.7) |
| 6 | 0101 | 0 | 1 | 0 | 0 | 0 | 1 | 0 | 7 (16.7) | 1 | 0 | 1 | 0 | 10 (33.3) |
| 7 | 0110 | 0 | 0 | 1 | 0 | 0 | 1 | 0 | 9 (21.4) | 0 | 1 | 1 | 0 | 12 (40.0) |
| 8 | 0111 | 0 | 1 | 1 | 0 | 0 | 1 | 0 | 11 (26.2) | 1 | 1 | 1 | 0 | 14 (46.7) |
| 9 | 1000 | 0 | 0 | 0 | 0 | 0 | 0 | 1 | 14 (33.3) | 0 | 0 | 0 | 1 | 16 (53.3) |
| 10 | 1001 | 0 | 0 | 1 | 0 | 0 | 0 | 1 | 18 (42.9) | 1 | 0 | 0 | 1 | 18 (60.0) |
| 11 | 1010 | 0 | 0 | 0 | 1 | 0 | 0 | 1 | 22 (52.4) | 0 | 1 | 0 | 1 | 20 (66.7) |
| 12 | 1011 | 0 | 0 | 1 | 1 | 0 | 0 | 1 | 26 (61.9) | 1 | 1 | 0 | 1 | 22 (73.3) |
| 13 | 1100 | 0 | 0 | 0 | 0 | 1 | 0 | 1 | 30 (71.4) | 0 | 0 | 1 | 1 | 24 (80.0) |
| 14 | 1101 | 0 | 0 | 1 | 0 | 1 | 0 | 1 | 34 (81.0) | 0 | 0 | 1 | 1 | 26 (86.7) |
| 15 | 1110 | 0 | 0 | 0 | 1 | 1 | 0 | 1 | 38 (90.5) | 0 | 1 | 1 | 1 | 28 (93.3) |
| 16 | 1111 | 0 | 0 | 1 | 1 | 1 | 0 | 1 | 42 (100.) | 1 | 1 | 1 | 1 | 30 (100.0) |

As shown in Table 3, in the third embodiment, for display of 16 gradations by means of four bits of the original image data, four subfields SF0, SF1, SF5 and SF6 are selected from low-order four gradations on a low brightness side, based on the first subfield data. Four subfields SF1, SF2, SF5 and SF6 are selected from intermediate-order four gradations, based on the second subfield data. The four subfields SF2, SF3, SF4 and SF6 are selected from high-order eight gradations on a high brightness side, based on the third subfield data. Each bit of the original image data is allocated to each of the subfields. Thereby, there is a difference of 1 in brightness between the gradations from the first to fourth gradations, a difference of 2 in brightness between the gradations from the fourth to eighth gradations, a difference of 3 in brightness between the eighth gradation and the ninth gradation, and a difference of 4 in brightness between the gradations from the ninth to sixteenth gradations. On the other hand, in the comparative example, from the first to sixteenth gradations, there is a constant difference of 2 in brightness between the gradations.

Figure 12:
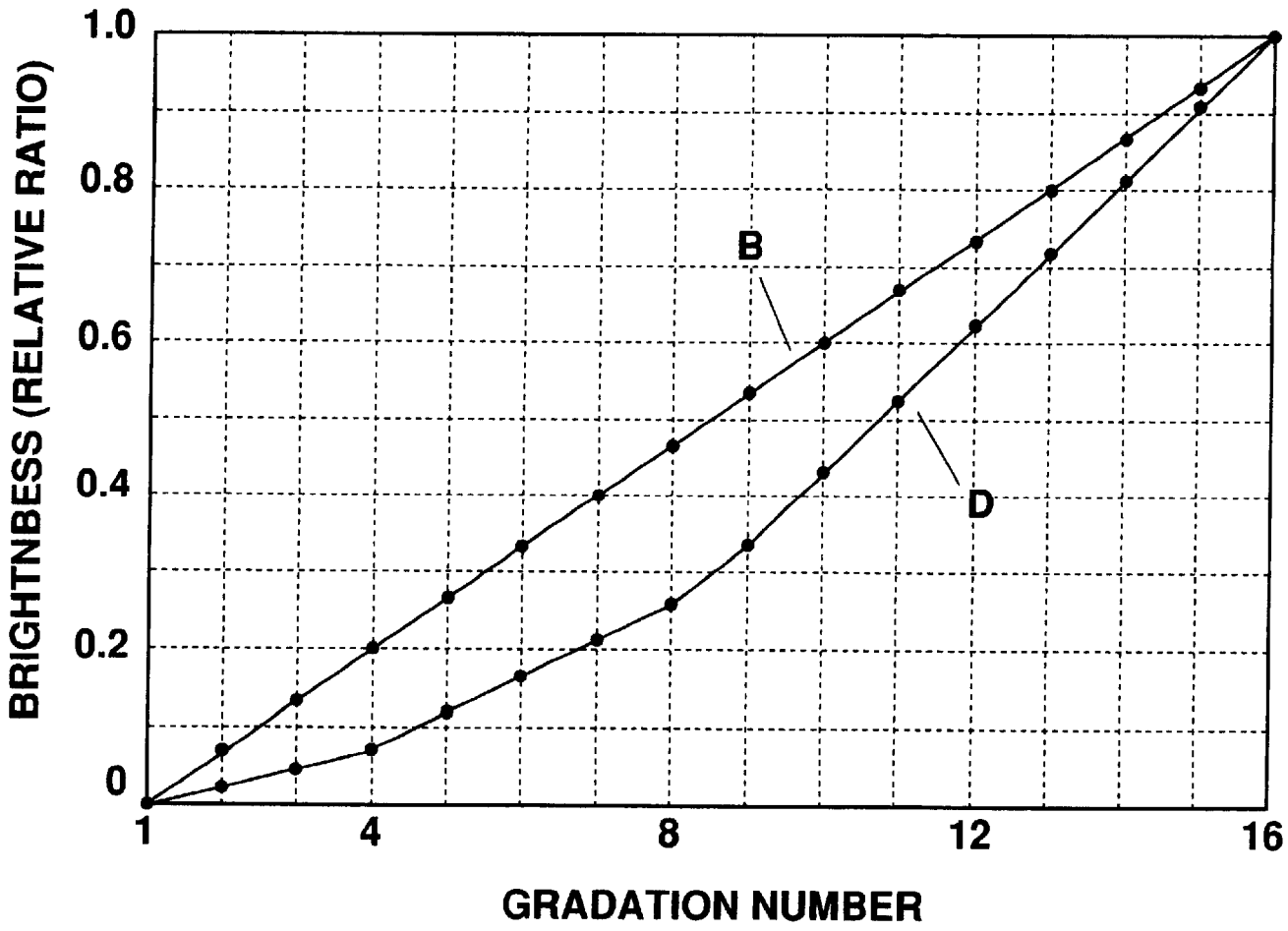
FIG. 12 is a graph showing a relationship between a gradation and a display brightness in the PDP according to the third embodiment.

In FIG. 12, the relationships between the gradation and the brightness obtained from Table 3 are shown by characteristic curves D and B for the third embodiment and the comparative example, respectively. The curve B shows the same comparative example as the curves B shown in FIGS. 4 and 8 and described in the first and second embodiments. The curve C shows a characteristic of the third embodiment. In the third embodiment, the difference in brightness between the gradations in the low brightness region including the first to fourth gradations is the smallest, and the difference in brightness between the gradations in the high brightness region including the ninth to sixteenth gradations is the largest.

In the same manner as the second embodiment of the four-bit/six-subfield system, the difference in brightness between the gradations is uniformly recognized over all the brightness regions in such a manner that the display characteristic is compensated by the human sensitivity. Incidentally, in the above four-bit/seven-subfield system, an obtained contrast ratio is smaller than in the four-bit/six-subfield system, but an obtained relative ratio of the brightness is equal to that of the four-bit/six-subfield system.

Figure 13:
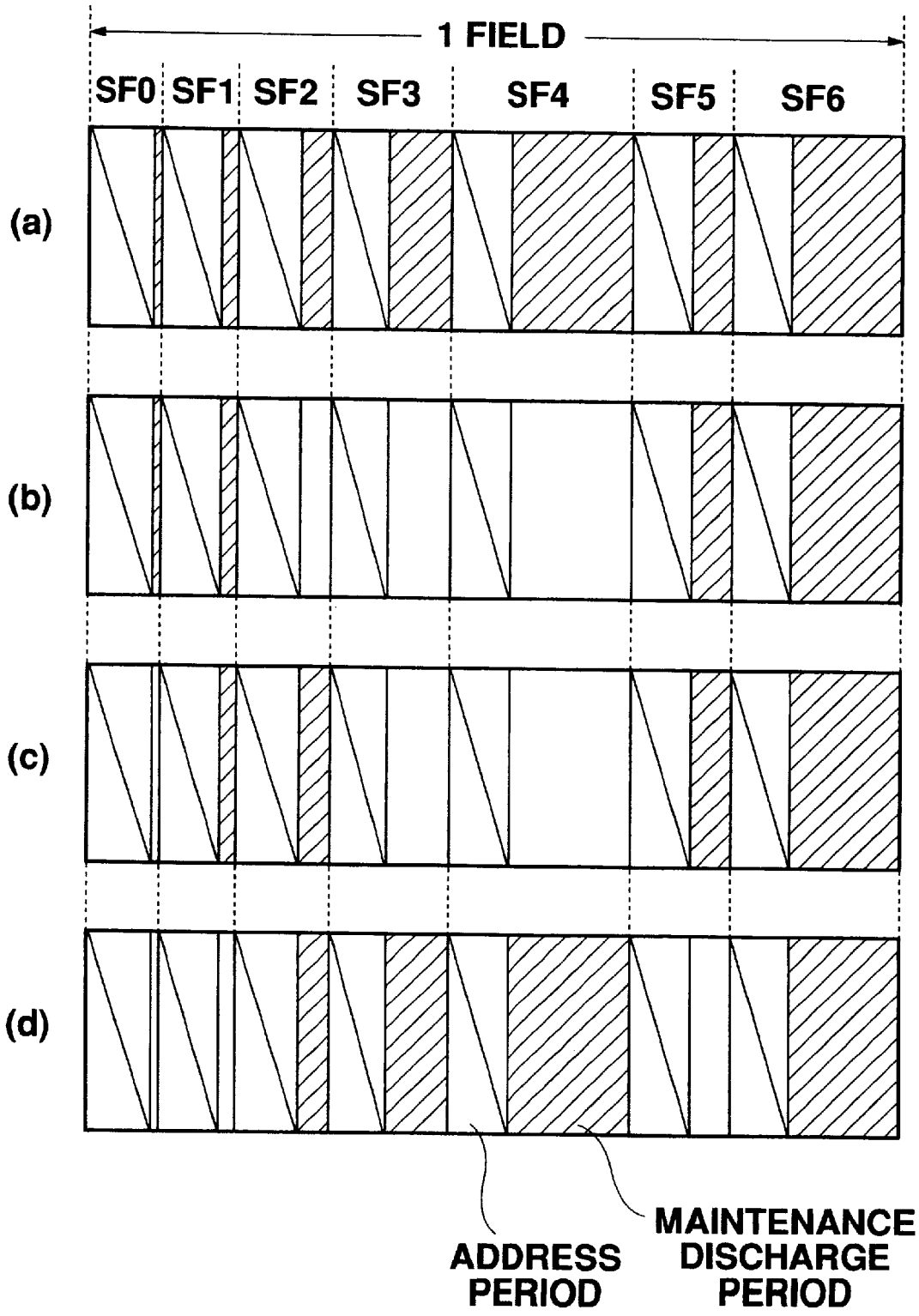
FIG. 13 shows combinations of subfields in a method of driving the PDP according to the third embodiment.

FIG. 13 shows constitutions of one field in the PDP driving method according to the third embodiment. (a) shown in FIG. 13 shows a constitution of one field prepared in the timing controller 35. The field is constituted of seven subfields SF0, SF1, SF2, SF3, SF4, SF5 and SF6 which have the address period and the maintenance discharge period. These subfields SF0, SF1, SF2, SF3, SF4, SF5 and SF6 have different lengths of the maintenance charge periods to indicate desired brightness ratios. The length of the maintenance charge period corresponds to the length of the lighting time, and is associated with the brightness. The relative ratio of lighting time of the subfields SF0, SF1, SF2, SF3, SF4, SF5 and SF6 is set as 1:2:4:8:16:5:14.

(b) shown in FIG. 13 shows one field constituted of four subfields SF0, SF1, SF5 and SF6 to which each bit of the original image data including the first to fourth gradations is allocated. (c) shown in FIG. 13 shows one field constituted of four subfields SF1, SF2, SF5 and SF6 to which each bit of the original image data including the fifth to eighth gradations is allocated. (d) shown in FIG. 13 shows one field constituted of four subfields SF2, SF3, SF4 and SF6 to which each bit of the original image data including the ninth to sixteenth gradations is allocated. Specifically, in one field constituted beforehand of seven subfields as (a) shown in FIG. 13, in accordance with the gradations to be displayed, four subfields are selectively prepared as (b), (c) or (d) shown in FIG. 13, to perform a gradation display by allocating each bit of the original image data to each of the subfields and controlling lighting and non-lighting.

What is claimed is:

1. A method of driving a flat panel display apparatus for multi-gradation display wherein setting each of a plurality of subfield periods to a pixel lighting period in accordance with a relative brightness ratio in one field period constituted of said plurality of subfield periods to display a desired brightness, dividing multiple gradations into a plurality of gradation groups between a lower brightness and a higher brightness, determining to which of said plurality of gradation groups a brightness level indicated by original image data belongs, selecting either one of a plurality of subfield period groups which are prepared by combining predetermined subfield periods of said plurality of subfield periods, by determining to which one of said plurality of gradation groups said original image data belongs, so that a difference in brightness between gradations in a gradation group on a lower brightness side among said plurality of gradation groups is smaller than a difference in brightness between gradations in a gradation group on a higher brightness side, associating said original image data with the respective subfield periods in said selected subfield period group, and performing the multi-gradation display by controlling lighting and non-lighting of each pixel in the subfield period.

2. The method of driving the flat panel display apparatus for multi-gradation display according to claim 1 wherein it is determined from a predetermined upper bit of said original image data to which one of said plurality of gradation groups the brightness level of said original image data belongs.

3. A method of driving a flat panel display apparatus wherein setting each of a plurality of subfield periods to a pixel lighting period in accordance with a relative brightness ratio in one field period constituted of a plurality of subfield periods to display a desired brightness, and controlling lighting and non-lighting of each pixel in said plurality of subfield periods, thereby controlling the total lighting time of each pixel in said one field period to perform multi-gradation display, multiple gradations being divided into a plurality of gradation groups between a lower brightness and a higher brightness, and a difference in brightness between gradations in a gradation group on a lower brightness side being made smaller than a difference in brightness between gradations in a gradation group on a higher brightness side.

4. The method of driving the flat panel display apparatus for multi-gradation display according to claim 3 wherein said one field period is constituted of n+1 subfield periods, $2^n$ levels of gradations are divided into a $2^{n-1}$-gradation group on a low brightness side and a $2^{n-1}$-gradation group on a high brightness side, by determining to which one of said $2^{n-1}$-gradation group on the low brightness side and said $2^{n-1}$-gradation group on the high brightness side said original image data belongs, predetermined n+1 or less subfield periods are selected from said n+1 subfield periods, so that the difference in brightness between the gradations in the gradation group on the low brightness side among said plurality of gradation groups becomes smaller than the difference in brightness between the gradations in the gradation group on the high brightness side, and said original image data is associated with said selected subfield periods, and by controlling lighting and non-lighting of each pixel in said selected subfield periods, a $2^n$ level gradation display is performed.

5. The method of driving the flat panel display apparatus for multi-gradation display according to claim 3 wherein said one field period is constituted of n+2 subfield periods, $2^n$ levels of gradations are divided into a $2^{n-2}$-gradation group on a low brightness side, a $2^{n-2}$-gradation group on an intermediate brightness side and a $2^{n-1}$-gradation group on a high brightness side, by determining to which one of said three gradation groups said original image data belongs, predetermined n+2 or less subfield periods are selected from said n+2 subfield periods, so that the difference in brightness between the gradations in the gradation group on the lower brightness side among said three gradation groups becomes smaller than the difference in brightness between the gradations in the gradation group on the higher brightness side, and said original image data is associated with said selected subfield periods, and by controlling lighting and non-lighting of each pixel in said selected subfield periods, a $2^n$-level gradation display is performed.

6. The method of driving the flat panel display apparatus for multi-gradation display according to claim 5 wherein each brightness difference in said $2^{n-2}$-gradation group on the low brightness side, said $2^{n-2}$-gradation group on the intermediate brightness side and said $2^{n-1}$-gradation group on the high brightness side is reduced successively from the $2^{n-1}$-gradation group on the high brightness side toward the $2^{n-2}$-gradation group on the intermediate brightness side and the $2^{n-2}$-gradation group on the low brightness side.

7. The method of driving the flat panel display apparatus for multi-gradation display according to claim 3 wherein said one field period is constituted of six subfield periods, sixteen levels of gradation are divided into a four-gradation group on a low brightness side, a four-gradation group on an intermediate brightness side and an eight-gradation group on a high brightness side, by determining to which one of said three gradation groups said original image data belongs, six or less predetermined subfield periods are selected from said six subfield periods, so that the difference in brightness between gradations in the gradation group on the lower brightness side among said three gradation groups becomes smaller than the difference in brightness between gradations in the gradation group on the higher brightness side, and each of four bits of said original image data is associated with said selected subfield periods, and by controlling lighting and non-lighting of a pixel in said selected subfield periods, a sixteen-level gradation display is performed.

8. The method of driving the flat panel display apparatus for multi-gradation display according to claim 3 wherein said one field period is constituted of n+3 subfield periods, $2^n$ gradations are divided into a $2^{n-2}$-gradation group on a low brightness side, a $2^{n-2}$-gradation group on an intermediate brightness side and a $2^{n-1}$-gradation group on a high brightness side, by determining to which one of said three gradation groups said original image data belongs, n+3 or less subfield periods are selected from said n+3 subfield periods, so that the difference in brightness between gradations in the gradation group on the lower brightness side among said three gradation groups becomes smaller than the difference in brightness between gradations in the gradation group on the higher brightness side, and said original image data is associated with said selected subfield periods, and by controlling lighting and non-lighting of each pixel in said selected subfield periods, a $2^n$-gradation display is performed.

9. The method of driving the flat panel display apparatus for multi-gradation display according to claim 8 wherein each brightness difference in said $2^{n-2}$-gradation group on the low brightness side, said $2^{n-2}$-gradation group on the intermediate brightness side and said $2^{n-1}$-gradation group on the high brightness side is reduced successively from the $2^{n-1}$-gradation group on the high brightness side toward the $2^{n-2}$-gradation group on the intermediate brightness side and the $2^{n-2}$-gradation group on the low brightness side.

10. The method of driving the flat panel display apparatus for multi-gradation display according to claim 3 wherein said one field period is constituted of seven subfield periods, sixteen levels of gradations are divided into a four-gradation group on a low brightness side, a four-gradation group on an intermediate brightness side and an eight-gradation group on a high brightness side, by determining to which one of said three gradation groups said original image data belongs, seven or less specified subfield periods are selected from said seven subfield periods, so that the difference in brightness between gradations in the gradation group on the lower brightness side among said three gradation groups becomes smaller than the difference in brightness between gradations in the gradation group on the higher brightness side, and each of four bits of said original image data is associated with said selected subfield periods, and by controlling lighting and non-lighting of each pixel in said selected subfield periods, a sixteen-level gradation display is performed.

* * * * *